United States Patent [19]

Hattori et al.

[11] 4,175,521

[45] Nov. 27, 1979

[54] AIR-FUEL RATIO ADJUSTING SYSTEM

[75] Inventors: Tadashi Hattori, Okazaki; Akira Takata; Tamotsu Fukuda, both of Toyota; Takamichi Nakase, Gamagori, all of Japan

[73] Assignees: Nippon Soken, Inc., Nishio; Toyota Jidosha Kogyo Kabushiki Kaisha, Toyota, both of Japan

[21] Appl. No.: 782,733

[22] Filed: Mar. 30, 1977

[30] Foreign Application Priority Data

Apr. 14, 1976 [JP] Japan ..... 51-42697

[51] Int. Cl.[2] ..... F01N 3/15; F02M 37/00

[52] U.S. Cl. ..... 123/119 D; 123/119 EC; 123/32 EE

[58] Field of Search ..... 123/32 EA, 119 D, 32 EE, 123/119 EC; 60/276, 285

[56] References Cited

U.S. PATENT DOCUMENTS

| | | | |
|---|---|---|---|
| 3,817,225 | 9/1974 | Priegel | 123/32 EA |
| 3,827,237 | 8/1974 | Linder et al. | 123/119 EC |
| 3,921,612 | 10/1975 | Aono | 123/119 EC |
| 4,023,357 | 5/1977 | Masaki | 123/119 EC |
| 4,052,968 | 10/1977 | Hattori et al. | 123/119 EC |
| 4,061,118 | 12/1977 | Kiyota | 123/119 EC |
| 4,072,137 | 2/1978 | Hattori et al. | 123/119 EC |
| 4,075,835 | 2/1978 | Hattori et al. | 123/119 EC |
| 4,077,207 | 3/1978 | Hattori et al. | 123/119 EC |
| 4,084,560 | 4/1978 | Hattori et al. | 123/119 EC |
| 4,084,563 | 4/1978 | Hattori et al. | 123/119 EC |

*Primary Examiner*—Samuel W. Engle
*Assistant Examiner*—S. A. Cangialosi
*Attorney, Agent, or Firm*—Cushman, Darby & Cushman

[57] ABSTRACT

Additional air is supplied through an additional air passage having a bypass valve into the main air passage of an internal combustion engine downstream of the throttle valve, and the amount of the additional air is controlled in accordance with the opening of the bypass valve. The direction of rotation of a bypass valve driving pulse motor is controlled in accordance with the output signal of an air-fuel mixture ratio sensor mounted in the exhaust system of the engine. Also the rotational speed of the pulse motor is varied in accordance with the operating conditions of the engine during warm-up operation.

9 Claims, 7 Drawing Figures

AIR-FUEL RATIO ADJUSTING SYSTEM

To ensure maximum exhaust gas purification efficiency of the modified engines which have been proposed for exhaust emission control of automobiles or to ensure optimum purification of exhaust gases by catalysts in those engines which have incorporated exhaust gas cleaning catalysts for exhaust emission control purposes, the air-fuel ratio of the mixture supplied to the engine must always be controlled properly. The present invention relates to an air-fuel mixture ratio adjusting system which meets these requirements satisfactorily, and more particularly the invention relates to such system which controls the amount of additional air.

An air-fuel ratio adjusting system of the above type has been proposed in which the oxygen content of the exhaust gases from an engine is detected and applied to a control unit, whereby the control unit determines the air-fuel ratio of the mixture fed to the engine and varies the passage area of an additional air passage bypassing the fuel nozzle and the throttle valve of the carburetor or the amount of additional air, thereby controlling the air-fuel mixture ratio at a predetermined ratio. With this conventional system, the air-fuel ratio sensor mounted in the exhaust pipe to detect the oxygen content of exhaust gases, for example, cannot function properly during cold starting periods of the engine, and consequently the control of a bypass valve mounted in the additional air passage is temporarily stopped until the engine temperature rises thus permitting the sensor to function properly.

The problem with this type of system is that since the carburetor has been set to a relatively small air-fuel ratio, if the control of the bypass valve is stopped until the engine warms up satisfactorily, the supply of excessively rich mixture will be continued for a longer period of time causing emission of such unburned constituents as CO and HC from the engine in great quantities.

Another problem with this type of system is that if the control of the air-fuel mixture ratio through the bypass valve is started with the engine being warmed up slightly, the air-fuel ratio sensor is not in condition to operate in a fully efficient manner and its response is also unsatisfactory, with the result that the air-fuel ratio of the mixture cannot be controlled satisfactorily causing the mixture to become excessively lean and making it impossible for the engine to operate properly and thereby giving rise to such phenomena as backfiring, engine stalling, etc.

Figure 1:
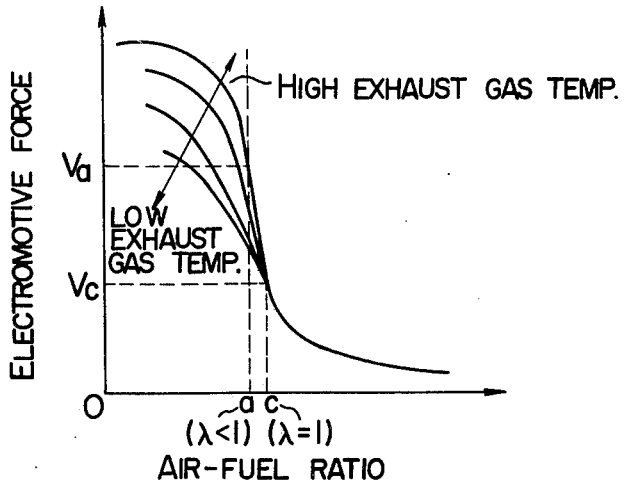
FIG. 1 is an output characteristic diagram showing the relationship between the variation of the electromotive force produced by an air-fuel ratio sensor used with this invention and the variation of the air-fuel mixture ratio.

The air-fuel ratio sensors which have been mounted in the exhaust pipes of the engines include oxygen content sensors employing zirconium dioxide, titanium dioxide, etc., and these sensors are such that the output electromotive forces or resistance value changes in a step fashion at around the stoichiometric air-fuel ratio (the excess air ratio $\lambda = 1$) as shown in FIG. 1. While the feedback control for controlling the ratio at around the stoichiometric air-fuel ratio with an air-fuel ratio sensor having such electric characteristic has been rated high, where the feedback control is required to achieve an air-fuel mixture ratio other than the stoichiometric air-fuel ratio as an exhaust emission control system, the conventional air-fuel ratio adjusting systems cannot meet the requirement.

On the other hand, as shown in FIG. 1, the electromotive force produced by the oxygen content sensor employing zirconium dioxide or the like is varied with the exhaust gas temperature, and this variation is particularly great in the higher ranges of electromotive force. The electromotive force also decreases with deterioration of the sensor itself. Thus, with the conventional systems in which the feedback control is effected to control the ratio at around the stoichiometric air-fuel ratio with the air-fuel ratio sensor employing zirconium dioxide, the characteristics of the air-fuel sensor will be changed depending on the location of the air-fuel ratio or the deterioration of the sensor itself, and therefore it is impossible to accurately feedback control the air-fuel ratio of the exhaust gases, particularly the air-fuel ratio which is smaller than the stoichiometric air-fuel ratio to return to the stoichiometric one. The reason is that in FIG. 1 a preset voltage $V_a$ which is to be compared with a voltage $V_c$ corresponding to the stoichiometric air-fuel ratio changes with the temperature of the exhaust gases.

The present invention has been made to overcome the foregoing deficiencies, and it is the object of this invention to provide an air-fuel ratio adjusting system designed to feedback compensate the air-fuel ratio of the mixture supplied to the engine by controlling the amount of additional air in accordance with the output signal of an air-fuel ratio sensor, wherein different time rates of change for increasing and decreasing the amount of additional air are used according to the engine conditions during warming up, whereby the air-fuel ratio of the mixture is controlled at a value other than the stoichiometric air-fuel ratio, and the mixture is prevented from becoming excessively lean during the cold starting of the engine, thus stabilizing the operation of the engine during the warm-up period without the emission of CO and HC in large quantities and thereby preventing the occurrence of such phenomena as backfiring and engine stalling.

Figure 2:
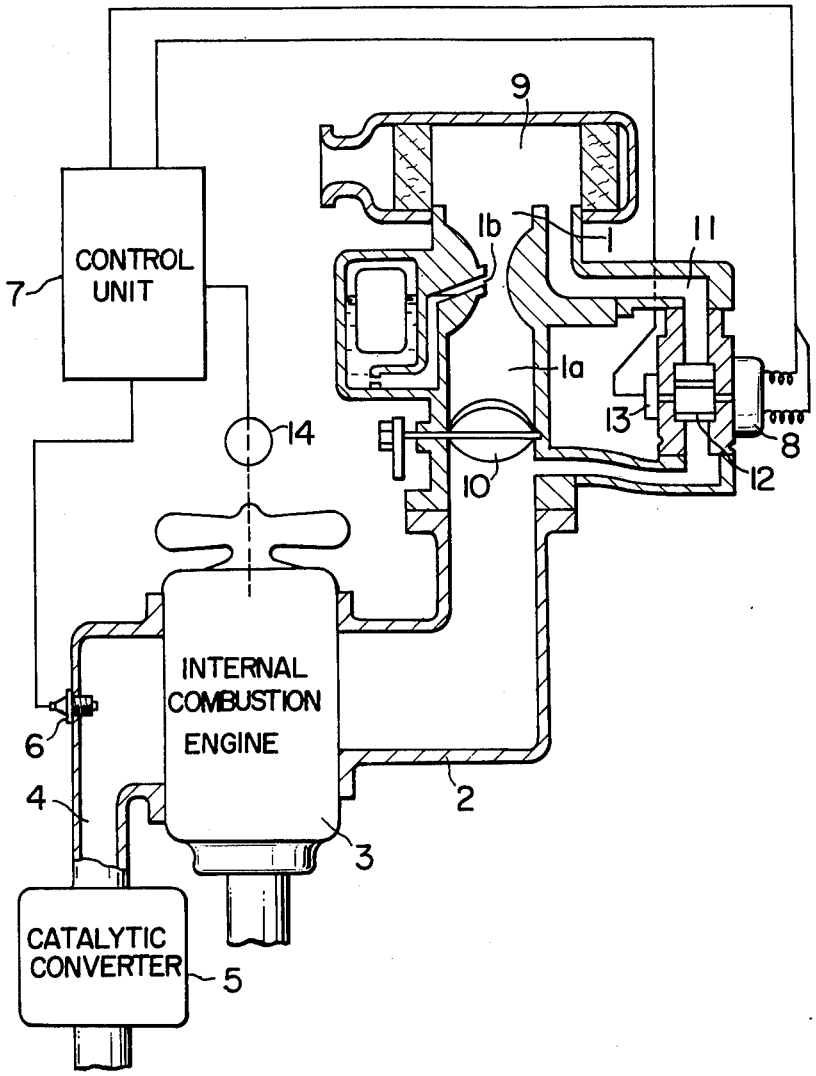
FIG. 2 is a schematic diagram showing an embodiment of the invention.

The present invention will now be described in reference to the illustrated embodiments. In FIG. 2, numeral 1 designates a carburetor for producing an air-fuel mixture, 2 an intake manifold for supplying the air-fuel mixture to an internal combustion engine 3, 4 an exhaust manifold through which the exhaust gases from the engine 3 are discharged, 5 a catalytic converter mounted in the exhaust manifold 4. The carburetor 1 has been adjusted to produce an air-fuel mixture which is slightly richer than that suited for the most effective operation of the catalytic converter 5, and the usual main air is supplied through a main passage 1*a* and mixed with the corresponding amount of fuel to produce the above-described mixture which in turn is supplied to the engine 3, burned in the engine 3 and then discharged to the atmosphere through the exhaust manifold 4, the catalytic converter 5 and a muffler which is not shown. Mounted in a portion of the exhaust passage of the exhaust manifold 4 is an air-fuel ratio sensor 6 which comprises an oxygen content sensor employing a metal oxide such as zirconium dioxide and produces a signal corresponding to the oxygen content of the exhaust gases. This air-fuel ratio signal from the air-fuel ratio sensor 6 is then applied to a control unit 7 whose output is used to operate driving means comprising a pulse motor 8, for example. Numeral 9 designates an air cleaner, 11 an additional air passage bypassing a fuel nozzle 1*b* and a throttle valve 10, and disposed in the passage 11 is a bypass valve 12 which varies the passage area of the passage 11. The bypass valve 12 is operated by the pulse motor 8 to control the amount of additional air supplied to the mixture produced in the carburetor 1. More specifically, the bypass valve 12, the additional air passage 11 and the pulse motor 8 constitute additional air adjusting means. The illustrated system controls in such a manner that since the carburetor 1 has been adjusted to produce a mixture which is slightly richer than that suited for the most effective operation of the catalytic converter, the deficit amount of air is supplied as additional air by varying the passage area of the additional air passage 11, so that eventually the mixture supplied to the engine 3 is controlled at the desired air-fuel ratio improving the purification rate of the catalytic converter 5. Numeral 13 designates a bypass valve fully closed position sensor for detecting the fully closed position of the bypass valve 12, and its contacts are opened when the bypass valve 12 is in the fully closed position. Numeral 14 designates a warm-up sensor for detecting the warm-up condition of the engine 3 by detecting, for example, the cooling water temperature, engine block temperature or ambient temperature of the engine 3, and it comprises, in this embodiment, a temperature sensor including thermistors and adapted to detect the cooling water temperature.

Figure 3:
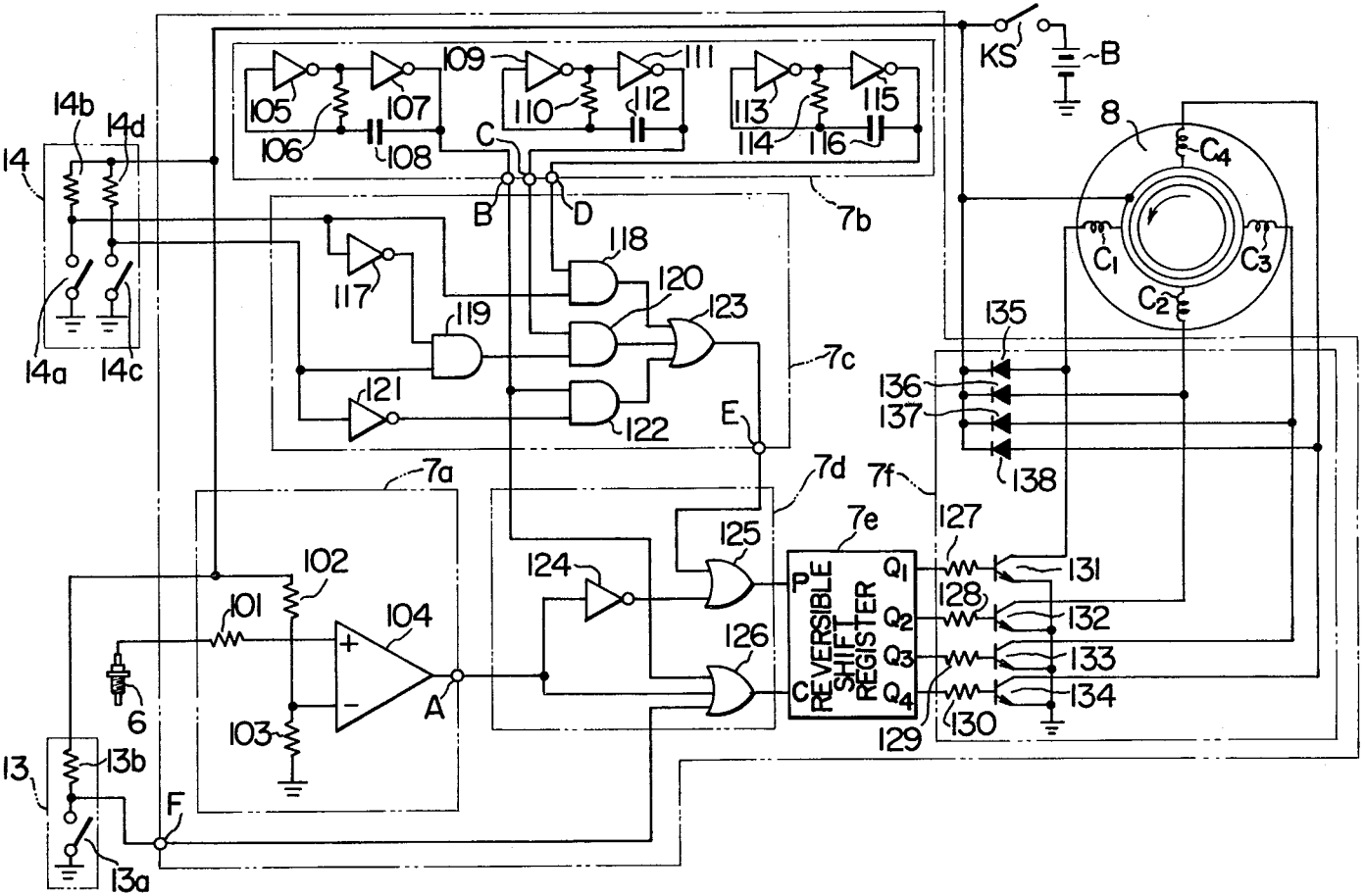
FIG. 3 is a circuit diagram showing a part of the embodiment shown in FIG. 2.

Next, the control unit 7 will be described in detail with reference to FIG. 3. In the Figure, numeral 7*a* designates an air-fuel ratio comparator circuit comprising an input resistor 101, a comparator 104 and voltage dividing resistors 102 and 103 for applying a reference voltage to the inverting input terminal of the comparator 104, and the noninverting input terminal of the comparator 104 is connected to the air-fuel ratio sensor 6 through the input resistor 101. The reference voltage determined by the dividing resistors 102 and 103 is preset to the electromotive force $V_C$ produced by the air-fuel ratio sensor 6 at around the stoichiometric air-fuel ratio. Consequently, when the air-fuel ratio detected by the air-fuel ratio sensor 6 is smaller than the stoichiometric air-fuel ratio, namely, when the mixture is rich, the air-fuel ratio comparator circuit 7*a* produces a "1" level signal at its output terminal A, whereas a "0" level signal is produced at the output terminal A when the detected air-fuel ratio is greater than the stoichiometric one or the mixture is lean.

Numeral 7*b* designates a pulse generating circuit comprising three oscillators provided by NOT gates 105, 107, 109, 111, 113 and 115, resistors 106, 110 and 114, and capacitors 108, 112 and 116 to produce pulse signals of three different frequencies at its output terminals B, C and D. Assuming that the pulse frequencies produced at the output terminals B, C and D are respectively designated as $f_B$, $f_C$ and $f_D$, the pulse frequencies are preset so that $$f_B > f_C > f_D.$$

Numeral 7*c* designates a bypass valve opening rate selection circuit comprising NOT gates 117 and 121, AND gates 118, 119, 120 and 122 and an OR gate 123 and adapted to receive, as its input signals, the signals from the warm-up sensor 14 and the pulse signal generating circuit 7*b*.

The warm-up sensor 14 will now be described in greater detail. The warm-up sensor 14 comprises two cooling water temperature detectors adapted to be turned on in response to temperatures higher than preset temperatures and including thermoswitches 14*a* and 14*c* which turn on and off reed switches by utilizing the Curie point of ferromagnetic material and resistors 14*b* and 14*d*, and its output terminals are connected to the bypass valve opening rate selection circuit 7*c*. The thermoswitches 14*a* and 14*c* are turned on and off by respectively detecting temperatures $T_1$ and $T_2$ (where $T_1 > T_2$). In the bypass valve opening rate selection circuit 7*c*, when the cooling water temperature of the engine 3 is lower than $T_1$, both the thermoswitches 14*a* and 14*c* are off and its two output terminals go to the "1" level, thus applying a "1" level signal to one input terminal of the AND gate 118, a "0" level signal to one input terminal of the AND gate 120 through the AND gate 119 and a "0" level signal to one input terminal of the AND gate 122 through the NOT gate 121 and thereby opening the AND gate 118 only. When the cooling water temperature is higher than $T_1$ but lower than $T_2$, the thermoswitch 14*a* is turned on and the thermoswitch 14*c* is turned off and consequently only the AND gate 120 is opened. When the cooling water temperature is higher than $T_2$, both the thermoswitches 14*a* and 14*c* are turned on and thus only the AND gate 122 is opened.

Consequently, when the cooling water temperature is lower than $T_1$, the pulse signals produced from the output terminal D of the pulse generating circuit 7*b* are delivered to an output terminal E of the bypass valve opening rate selection circuit 7*c* through the AND gate 118 and the OR gate 123. Similarly, when the cooling water temperature is above $T_1$ but below $T_2$, the pulse signals produced from the output terminal C of the pulse generating circuit 7*b* are delivered to the output terminal E of the selection circuit 7*c* through the AND gate 120 and the OR gate 123. When the cooling water temperature is higher than $T_2$, the pulse signals produced from the output terminal B of the pulse generating circuit 7*b* are delivered to the output terminal E of the selection circuit 7*c* through the AND gate 122 and the OR gate 123.

Numeral 7*d* designates a command circuit comprising a NOT circuit 124 and OR gates 125 and 126 which constitute a control logic circuit and adapted to receive, as its input signals, the signals from the air-fuel ratio comparator circuit 7*a*, the pulse generating circuit 7*b*, the bypass valve opening rate selection circuit 7*c* and the bypass valve fully closed position sensor 13. More specifically, the OR gate 125 has its one input terminal connected to the output terminal E of the bypass valve opening rate selection circuit 7*c* and its other input terminal connected to the output terminal A of the air-fuel ratio comparator circuit 7*a* through the NOT gate 124, and the output terminal of the OR gate 125 is connected to an input terminal P of a reversible shift register *7e*. The OR gate 126 has its one input terminal connected to the output terminal B of the pulse generating circuit *7b*, its another input terminal connected to an output terminal F of the bypass valve fully closed position sensor 13 comprising a switch 13*a* adapted to be turned off when the bypass valve 12 is in its fully closed position and the remaining input terminal connected to the output terminal A of the air-fuel ratio comparator circuit *7a*, and the output terminal of the OR gate 126 is connected to an input terminal C of the reversible shift register *7e*.

The reversible shift register *7e* is designed so that when the pulse signals are applied to the input terminal P, its output terminals $Q_1$, $Q_2$, $Q_3$ and $Q_4$ are sequentially shifted in this order, whereas when the pulse signals are applied to the input terminal C, the output terminals $Q_4$, $Q_3$, $Q_2$ and $Q_1$ are sequentially shifted in this order. The output terminals $Q_1$, $Q_2$, $Q_3$ and $Q_4$ are respectively connected to a switching circuit *7f* comprising resistors 127, 128, 129 and 130, transistors 131, 132, 133 and 134 and back electromotive force absorbing diodes 135, 136, 137 and 138, and the switching circuit *7f* is connected to field coils $C_1$, $C_2$, $C_3$ and $C_4$ of the pulse motor 8. As a result, when the pulse signals are applied to the input terminal P of the reversible shift register *7e*, the transistors 131, 132, 133 and 134 are sequentially turned on and the field coils $C_1$, $C_2$, $C_3$ and $C_4$ of the pulse motor 8 are sequentially energized two phases at a time to rotate the pulse motor 8 in the direction of the arrow. When the pulse motor 8 is rotated in the direction of the arrow, the bypass valve 12 is operated in a direction which opens it. On the contrary, when the pulse signals are applied to the input terminal C of the reversible shift register *7e*, the pulse motor 8 is rotated in a direction opposite to the direction of the arrow, and the bypass valve 12 is operated in a direction which closes it. It is needles to say that if the frequency of the pulse signals applied to the input terminal P of the reversible shift register *7e* is lower than that of the pulse signals applied to the other input terminal C, the absolute value of the rotational speed of the pulse motor 8 in the direction of the arrow is lower than that of the rotational speed in the opposite direction. The voltage of a battery B is applied to the control unit 7 and the pulse motor 8 by way of an ignition key switch KS of the engine 3.

With the construction described above, the system of this invention operates as follows. Firstly, when the electromotive force produced by the air-fuel ratio sensor 6 is higher than the preset voltage $V_C$, the air-fuel ratio comparator circuit *7a* determines that the air-fuel ratio of the mixture supplied to the engine 3 is small, and a "1" level signal is produced at its ouput terminal A.

This "1" level signal is inverted by the NOT gate 124, and a "0" level signal is applied to the input of the OR gate 125. Consequently, the OR gate 125 is opened, and the pulse signals produced at the output terminal E of the bypass valve opening rate selection circuit *7c* are applied to the input terminal P of the reversible shift register *7e* through the OR gate 125 as the output signals of the command circuit *7d*. As a result, the pulse motor 8 is rotated in the direction of the arrow and the opening of the bypass valve 12 is increased, with the result that the amount of additional air fed into the main passage 1*a* downstream of the throttle valve 10 is increased in accordance with the opening of the bypass valve 12, and the air-fuel ratio of the mixture supplied to the engine 3 is also increased.

In this embodiment, the running speed of the pulse motor 8 is dependent on the frequency of the pulse signals produced from the pulse generating circuit *7b*. When the engine 3 is cold and the cooling water temperature is below $T_1$ as, for example, during the cold starting period, the pulse motor 8 is driven by the pulse signals of the frequency $f_D$ and consequently the time rate of change in the opening of the bypass valve 12 or the time rate of change in the amount of additional air is very small. On the other hand, when the cooling water temperature is above $T_1$ but below $T_2$ as, for example, during the warming up of the engine 3, the pulse motor 8 is driven by the pulse signals of the frequency $f_C$, and thus the time rate of change in the amount of additional air is still relatively small, though it is high as compared with that obtained when the cooling water temperature was below $T_1$. When the cooling water temperature is higher than $T_2$, the pulse motor 8 is driven by the pulse signals of the frequency $f_B$, and thus the time rate of change in the amount of additional is returns to the normal rate.

On the other hand, when the amount of additional air is increased so that the electromotive force from the air-fuel ratio sensor 6 becomes lower than the preset voltage $V_C$, the air-fuel ratio comparator circuit *7a* produces a "0" level signal. In this case, during the time that the bypass valve 12 is not in the fully closed position, the bypass valve fully closed position sensor 13 produces a "0" level signal at its output terminal F and this signal is applied to the OR gate 126. Consequently, two of the three input terminals of the OR gate 126 respectively receive a "0" level signal, and the command circuit *7d* applies the pulse signals having the frequency $f_B$ and produced at the output terminal B of the pulse generating circuit *7b* to the input terminal C of the reversible shift register *7e* through the OR gate 126. As a result, the pulse motor 8 is rotated in the direction opposite to the direction of the arrow at the normal speed, and the bypass valve 12 is operated in the direction which closes it. When this occurs, the amount of the additional air supplied to the engine downstream of the throttle valve 10 is rapidly reduced, and the air-fuel ratio of the mixture supplied to the engine 3 is also reduced. In this case, when the bypass valve 12 is moved into its fully closed position, the switch 13*a* of the bypass valve fully closed position sensor 13 is opened and a "1" level signal is produced at the output terminal F. Thus, the OR gate 126 continuously produces a "1" level signal, and the movement of the bypass valve 12 is stopped, thus preventing it from being moved further in the closing direction and thereby preventing damages to the bypass valve 12 and the pulse motor 8. It is evident that since the rotational speed of the bypass valve 12 is always controlled by pulses of the frequency $f_B$ for decreasing the amount of additional air, the time rate of change for decreasing the amount of additional air is greater than or equal to that for increasing the amount of additional air.

Figure 4:
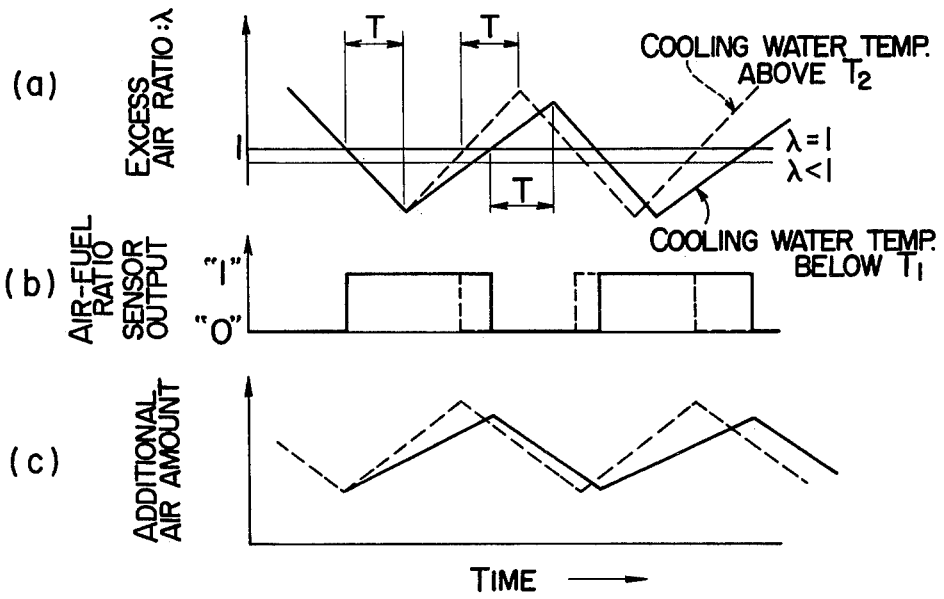
FIG. 4 is a characteristic diagram which is useful in explaining the operation of the embodiment of FIG. 2, showing the variation with time of the excess air ratio, the air-fuel ratio sensor output and the additional air amount.

In FIG. 4, the solid lines show the variation with time of the excess air ratio $\lambda$ of the exhaust gases in the exhaust manifold 4, the output of the air-fuel ratio sensor 6 and the amount of additional air adjusted by the additional air adjusting means with the cooling water temperature being below $T_1$ during the above-mentioned operation. In the Figure, the dotted lines show the similar variations with the cooling water temperature being above $T_2$. In the Figure, the amount of additional air is increased with time while the excess air ratio $\lambda$ remains $\lambda<1$ (the air-fuel ratio of the mixture is smaller than the stoichiometric air-fuel ratio), whereas the amount of additional air is decreased with time while the excess air ratio $\lambda$ remains $\lambda>1$. Where the cooling water temperature is above $T_2$ so that the same time rate of change is used for increasing and decreasing the amount of additional air, the excess air ratio becomes $\lambda=1$, the feedback control is effected to attain the stoichiometric air-fuel ratio.

On the other hand, where the bypass valve 12 is controlled by the control unit 7 so that its opening rate is decreased as compared with its closing rate as will be the case when the cooling water temperature is below $T_1$, the time rate of change for increasing the amount of additional is of course decreased as compared with that for decreasing the amount of additional air. Consequently, the average value of the excess air ratio $\lambda$ becomes $\lambda<1$, namely, the air-fuel ratio of the mixture is controlled at a value smaller than the stoichiometric air-fuel ratio.

Also, the bypass valve opening rate used for the cooling water temperature below $T_1$ differs from that used for the cooling water temperature above $T_1$ but below $T_2$, that is, the opening rate for the cooling water temperature below $T_1$ is lower, and consequently the richness of the mixture becomes relatively high when the cooling water temperature is below $T_1$.

In FIG. 4, when the amount of additional air attains its maximum or minimum, the excess air ratio attains its maximum or minimum after the expiration of a time T, and this is due to the fact that the delay time T is required before the mixture adjusted by the additional air fed downstream of the throttle valve 10 is drawn into the engine 3, burned in the engine 3 and discharged to the exhaust manifold 4.

In this way, the air-fuel ratio of the mixture is controlled in accordance with the cooling water temperature or the warming up condition of the engine 3, thus preventing the mixture from becoming excessively lean during warm-up periods of the engine 3. As a result, stable operation of the engine 3 is ensured even during the warm-up operation, thus preventing the occurrence of backfiring and engine stalling phenomena.

After the engine 3 has warmed up, the mixture is maintained at the stoichiometric air-fuel ratio, and the exhaust gases are purified by the catalytic converter 5 with greater efficiency.

Figure 5:
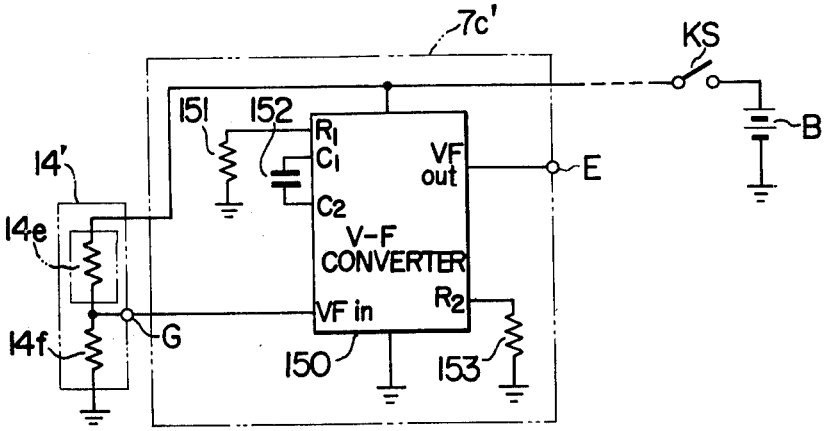
FIG. 5 is a circuit diagram for the principal parts of another embodiment of the invention.

While, in the embodiment of the invention described above, the air-fuel ratio of the mixture is controlled sequentially at three different levels of the warm-up condition of the engine 3, it will be more effective to continuously control the air-fuel ratio of the mixture in accordance with the warming up condition of the engine 3 as in the case of another embodiment which will be described hereinafter. In FIG. 5 showing another embodiment of the invention, a warm-up sensor 14' comprises a cooling water detector **14*e* consisting of a thermistor or the like whose resistance value varies with temperature and disposed in the cooling water passage and a fixed resistor 14*f***, and the output voltage at its output terminal G decreases as the cooling water temperature decreases, while the output voltage increases as the cooling water temperature increases.

An opening rate selection circuit **7*c'* comprises a V−F converter 150 (e.g., the RCA CD4046A) for producing pulse signals of a frequency corresponding to its input voltage, a resistor 151 for determining the frequency range of the output pulses of the V−F converter 150, a capacitor 152, and a resistor 153 for setting the offset pulse frequency of the V−F converter 150**.

Figure 6:
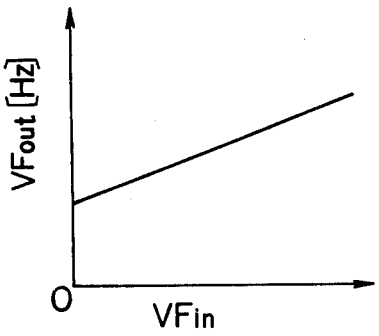
FIGS. 6 and 7 are characteristic diagrams which are useful in explaining the operation of the embodiment shown in FIG. 5.

In the embodiment described above, the input-output characteristic of the V−F converter 150 is so selected that its output pulse frequency increase with increase in the input voltage as shown in FIG. 6. Consequently, the V−F converter 150 whose input terminal VFin is connected to an output terminal G of the warm-up sensor 14', produces from its output terminal VFout pulse signals having a frequency substantially proportional to the cooling water temperature of the engine 3, and the pulse signals are applied to the command circuit **7*d*** by way of its output terminal E.

Figure 7:
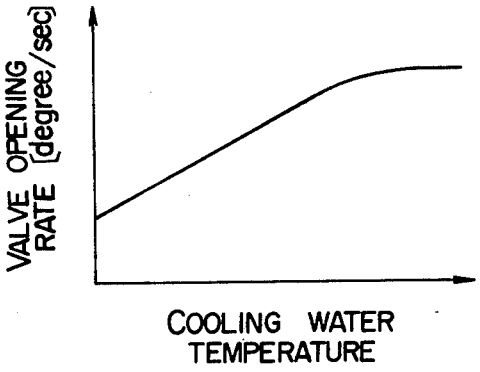

Consequently, the opening rate of the bypass valve 12 which is dependent on the pulse signals produced from the V−F converter 150, is varied in accordance with the cooling water temperature as shown in FIG. 7 and is controlled in accordance with the warming up condition of the engine 3. In this embodiment, the pulse frequency produced at the output terminal B of the pulse generating circuit **7*b* must be selected equal to the maximum pulse frequency of the V−F converter 150 so that the opening rate of the bypass valve becomes equal to its closing rate after the engine 3 has warmed up. In this embodiment, the pulse generating circuit 7*b* requires only one oscillator, and the other components will not be described since they are similar to their counterparts in the embodiment shown in FIG. 3**.

In the above-described embodiments, as regards the ratio between the opening and closing rates of the bypass valve 12 during the warm-up period, the setting of the warm-up sensors 14 and 14', the pulse generating circuit **7*b* and the opening rate selection circuits 7*c* and 7*c'* must, of course, be selected to suit the warm-up characteristic of the engine 3**.

What we claim is:

1. An air-fuel ratio adjusting system for an internal combustion engine which includes main air supply means having a throttle valve therein, for producing air-fuel mixture to be supplied to the engine, and an exhaust system for emitting exhaust gases, comprising:

an air-fuel ratio sensor disposed in the exhaust system, for sensing the air-fuel ratio of the mixture from oxygen content of the exhaust gases;

additional air supply means including a bypass valve, for supplying additional air into the main air supply means on a downstream side of the throttle valve, the amount of the additional air corresponding to the degree of opening of the bypass valve;

bypass valve driving means connected to said bypass valve for moving said bypass valve;

an engine warm-up condition sensor for sensing the warm-up condition of the engine to produce an engine condition signal; and a control unit connected to said air-fuel ratio sensor, said bypass valve driving means, and said engine warm-up condition sensor, for controlling said bypass valve driving means to move said bypass valve at a speed which varies with the engine condition signal, and in a direction of maintaining the air-fuel ratio of the mixture at a target value, the moving speed of said bypass valve in a leaner direction being varied to decrease said target value until said air-fuel ratio sensor has been activated completely.

2. A system according to claim 1, wherein said engine warm-up condition sensor includes thermoswitch means connected to a body of said engine for sensing cooling water temperature of said engine.

3. A system according to claim 1, wherein said control unit includes a reversible shift register circuit for producing a shifting pulse signal whose frequency is proportional to that of an input signal applied thereto, and wherein said bypass valve driving means includes a pulse motor coupled to said bypass valve and connected to said shift register circuit, responsive to the shifting pulse signal for moving said bypass valve at a speed proportional to the frequency of the shifting pulse signal.

4. A system according to claim 3, wherein said control unit further includes:

a plurality of oscillator circuits for producing oscillation signals whose frequencies differ from each other; and a bypass valve opening rate selection circuit connected to said engine warm-up condition sensor, said oscillator circuits and said reversible shift register circuit, responsive to said engine condition signal for selecting one of the oscillation signals and applying selected signal to said reversible shift register circuit;

an air-fuel ratio comparator circuit connected to said air-fuel ratio sensor and including a voltage comparator and a voltage divider, for comparing an output voltage of said air-fuel ratio sensor with a reference voltage produced by said voltage divider, to produce a comparison signal whose voltage level changes when one of the compared voltages exceeds the other; and a bypass valve moving direction selection circuit conected to said air-fuel ratio comparator circuit, said bypass valve opening rate selection circuit, one of the oscillator circuits and said shift register circuit, responsive to the comparison signal for passing, to said shift register circuit, one of the signal selected by said rate selection circuit and the oscillation signal produced by said one of the oscillators, said shift register circuit shifting reversely when receiving the latter.

5. A system according to claim 3, wherein said control unit further includes:

a voltage-to-frequency converter circuit connected to said engine warm-up condition sensor and said shift register circuit, for producing an oscillation output signal which is applied to said shift register circuit, the frequency of said oscillation output signal corresponding to said engine condition signal;

a fixed frequency oscillator circuit for producing an oscillation signal of fixed frequency;

an air-fuel ratio comparator circuit connected to said air-fuel ratio sensor and including a voltage comparator and a voltage divider, for comparing an output voltage of said air-fuel ratio sensor with a reference voltage produced by said voltage divider, to produce a comparison signal whose voltage level changes when one of the compared voltages exceeds the other; and a bypass valve moving direction selection circuit connected to said air-fuel ratio comparator circuit, said voltage-to-frequency converter circuit, said fixed frequency oscillator and said shift register circuit, responsive to the comparison signal for passing, to said shift register circuit, one of the variable frequency signal produced by said voltage-to-frequency converter circuit and the fixed frequency signal produced by said fixed frequency oscillator circuit, said shift register circuit shifting reversely when receiving the latter.

6. A system according to claim 4, wherein said bypass valve driving means includes a switch connected to said bypass valve and said bypass valve moving direction selection circuit, said switch being operable to prevent said direction selection circuit from passing the selected signal to said shift register circuit when said bypass valve is fully closed.

7. A system according to claim 4, wherein said bypass valve opening rate selection circuit includes AND gates each thereof connected to each of the oscillators and said engine warm-up condition sensor, and an OR gate connected to said AND gates.

8. A system according to claim 4, wherein said bypass valve moving direction selection circuit includes:

a first OR gate having input terminals connected to said opening rate selection circuit and said air-fuel ratio comparator circuit, and an output terminal connected to said shift register circuit; and a second OR gate having input terminals connected to said one of the oscillator circuits and said air-fuel ratio comparator circuit, and an output terminal connected to said shift register circuit.

9. A system according to claim 5, wherein the frequency of said fixed frequency oscillator circuit corresponds to the maximum oscillation frequency of said voltage-to-frequency converter circuit.

* * * * *